US006026971A

United States Patent [19]

Lundgren

[11] Patent Number: 6,026,971

[45] Date of Patent: Feb. 22, 2000

[54] LEVER OPERATED OPENER FOR CONTAINER

[76] Inventor: James F. Lundgren, 723 71st Ave. North, St. Petersburg, Fla. 33702

[21] Appl. No.: 09/240,267

[22] Filed: Jan. 29, 1999

Related U.S. Application Data

[63] Continuation-in-part of application No. 08/541,340, Oct. 10, 1995, abandoned.

[51] Int. Cl.[7] ..... B65D 17/34

[52] U.S. Cl. ..... 220/269

[58] Field of Search ..... 220/269, 270, 220/272, 273

[56] References Cited

U.S. PATENT DOCUMENTS

| | | | |
|---|---|---|---|
| 3,221,924 | 12/1965 | Harvey et al. | 220/269 X |
| 3,301,434 | 1/1967 | Harvey et al. | 220/269 X |
| 3,397,811 | 8/1968 | Lipske . | |
| 3,424,337 | 1/1969 | Von Stocker . | |
| 3,448,887 | 6/1969 | Geiger . | |
| 4,247,014 | 1/1981 | Walz | 220/269 |
| 4,276,993 | 7/1981 | Hasegawa | 220/269 |
| 4,350,261 | 9/1982 | Roth | 220/270 |
| 4,674,649 | 6/1987 | Pavely | 220/270 X |
| 4,733,793 | 3/1988 | Moen | 220/269 |
| 4,951,835 | 8/1990 | DeMars et al. | 220/269 |
| 5,131,555 | 7/1992 | DeMars et al. | 220/269 |
| 5,224,618 | 7/1993 | Garbiso | 220/269 |
| 5,248,053 | 9/1993 | Lundgren | 220/269 |
| 5,335,808 | 8/1994 | Lee | 220/269 |
| 5,497,896 | 3/1996 | Shand | 220/269 |

*Primary Examiner*—Stephen K. Cronin
*Attorney, Agent, or Firm*—Frijouf, Rust & Pyle, P.A.

[57] ABSTRACT

An improvement to an easy opening beverage container lever operated opener comprising an operating lever with a controllably flexible lift end. A lift end of the operating lever is raised to allow an operator to engage a finger on the lift end of the operating lever and to proceed with the container opening process. In one embodiment of the invention, the operating lever is rotatable along an incline plane to raise the lift end of the operating lever to allow an operator to engage a finger on the lift end of the operating lever and to proceed with the container opening process.

20 Claims, 7 Drawing Sheets

LEVER OPERATED OPENER FOR CONTAINER

CROSS-REFERENCE TO RELATED APPLICATIONS

This is a continuation-in-part of U.S. patent application Ser. No. 08/541,340 filed Oct. 10, 1995, now abandoned. All subject matter set forth in application Ser. No. 08/541,340 is hereby incorporated by reference into the present application as if fully set forth herein.

BACKGROUND OF THE INVENTION

1. Field of the Invention

This invention relates to an easy opening container employing a lever operated opener and more specifically to a novel lever and container end structure resulting in improved lifting characteristics for a primary positioned operating lever.

2. Background of the Invention

State of the art beverage container lever operated opening mechanism teaches that in order to effectively place one's finger on the body operating lever of an opening mechanism, one must first engage in an unsafe and inconvenient act of inserting ones fingernail or some thin object between the opener lift end and beverage container top panel. This must be done in order to pry the lever to a point where one can effectively engage a finger on the contact surface of the operating lever.

U.S. Pat. No. 4,276,993 to Hasegawa discloses a typical representation of present day state-of-the-art beverage container lever operated opening mechanism. Hasegawa shows a phase of lifting an operating lever of a beverage container opening mechanism. However, Hasegawa fails to show the unsafe and inconvenient act of initial lifting of operating lever.

U.S. Pat. No. 5,248,053 to Lundgren discloses an improvement to Hasegawa comprising a novel incline plane cooperating with the operating lever that easily raises the operating lever lift end to allow an operator to safely and efficiently engage a finger on the lift end of the operating lever and proceed with the opening process. The operating lever, secured by a centrally located rivet in the normal manner, is initially positioned at more or less right angle to the longitudinal axis of container scored closure disk. Pivoting the operating lever from the initial position up the incline plane to a point where the lever body longitudinal axis is generally in line with the longitudinal axis of the container. The lift end of the operating lever is raised to a point where an operator can engage a finger on the lift end of the operating lever. Unfortunately, in order to raise the lift end to a useful height, the incline plane has to be raised to such a height that it interferes with container end nesting. Although the theory of operation is correct, in practice, the necessary height of the inclined plane created an inability to nest and causes the end to be useless in modern day automated container filling and sealing systems.

The improvement of U.S. Pat. No. 5,248,053 by Lundgren over U.S. Pat. No. 4,276,993 to Hasegawa solved some of the problem of the prior art but did not provide a complete solution.

Thus a need exists for a beverage container opening that overcomes problems associated with the aforementioned typical representations of prior art devices. It is to the provision of such an opening mechanism that this invention is primarily directed.

Therefore, it is an object of the present invention to provide an improvement over U.S. Pat. No. 5,248,053 to Lundgren that solves the lifting problem while staying within the design limits demanded by the automated canning industry.

Another object of this invention is to provide for the safe and efficient lifting of an operating lever of a typical easy opening beverage container having an end panel with a scored area defining a closure disc adapted to be severed from the panel and pushed into the container by the action of an operating lever. The operating lever has an anchoring lug riveted to the exterior surface of the container top panel. The lug also serves as a hinge during the opening process. The operating lever has a nose portion at one end generally overlying the disc and a lift portion at the opposite end.

Another object of this invention is to provide an opener for a top panel of a container which is suitable for use with conventional containers.

Another object of this invention is to provide an opener for a top panel of a container which is suitable for use with conventional processing machines at a filling plant.

Another object of this invention is to provide an opener for a top panel of a container which does not increase the height of the product and allows for nesting of the product in a conventional manner.

Another object of this invention is to provide an opener for a top panel of a container which decreases the cost of the product.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description setting forth the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an opener for a container, comprising a top panel having a scored area for defining a closure portion which is frangibly secured to the top panel for enabling the closure portion to be severed from the panel. An operating lever has a nose portion and a lift portion with a controlled flex portion being disposed therebetween. The lift portion has an opening for receiving a finger of an operator. The operating lever is secured to the top panel with the nose portion of the operating lever being disposed proximate the closure portion and with the lift portion of the operating lever being disposed remote therefrom. The controlled flex portion enables the lift portion to bend upwardly at the controlled flex portion relative to the nose portion upon raising the lift portion by an operator to expose the opening in the lift portion. The upwardly bend lift portion facilitates the insert of a finger of the operator into the opening for enabling the operator to raise the lift portion of the operating lever to sever the closure portion from the top panel to open the container.

In a more specific example of the invention, the operating lever is secured to the top panel by an anchoring rivet interposed between the lift portion and the nose portion of the operating lever. The lift portion of the operating lever has a greater longitudinal length than a longitudinal length of the nose portion for providing a mechanical advantage for the operating lever.

The nose portion defines a width of the operating lever and the lift portion defines a width of the operating lever. In one embodiment of the invention, the width of the nose portion is substantially similar to the width of the lift portion. The operating lever is in the general form of an oval. In another embodiment of the invention, the width of the nose portion is substantially less than the width of the lift portion. The operating lever is in the general form of a tear drop.

A control notch defined in the controlled flex portion for controlling the flexibility of the controlled flex portion. Preferably, the control notch varies the width of the controlled flex portion for controlling the flexibility of the controlled flex portion.

In another specific example of the invention, the invention comprises an opener for a container having a top panel having a scored area for defining a closure portion which is frangibly secured to the top panel for enabling the closure portion to be severed from the panel. The top panel has an arcuate incline plane extending from a surface of the top panel. An operating lever has a nose portion and a lift portion with a controlled flex portion being disposed therebetween. The lift portion has an opening for receiving a finger of an operator. The operating lever is rotatably secured to the top panel with the nose portion of the operating lever being disposed proximate the closure portion and with the lift portion of the operating lever being disposed adjacent the arcuate incline plane. The controlled flex portion enables the lift portion to bend upwardly at the controlled flex portion relative to the nose portion upon rotation of the operating lever along the incline plane by an operator to expose the opening in the lift portion. The upwardly bend lift portion facilitates the insert of a finger of the operator into the opening for enabling the operator to raise the lift portion of the operating lever to sever the closure portion from the top panel to open the container.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
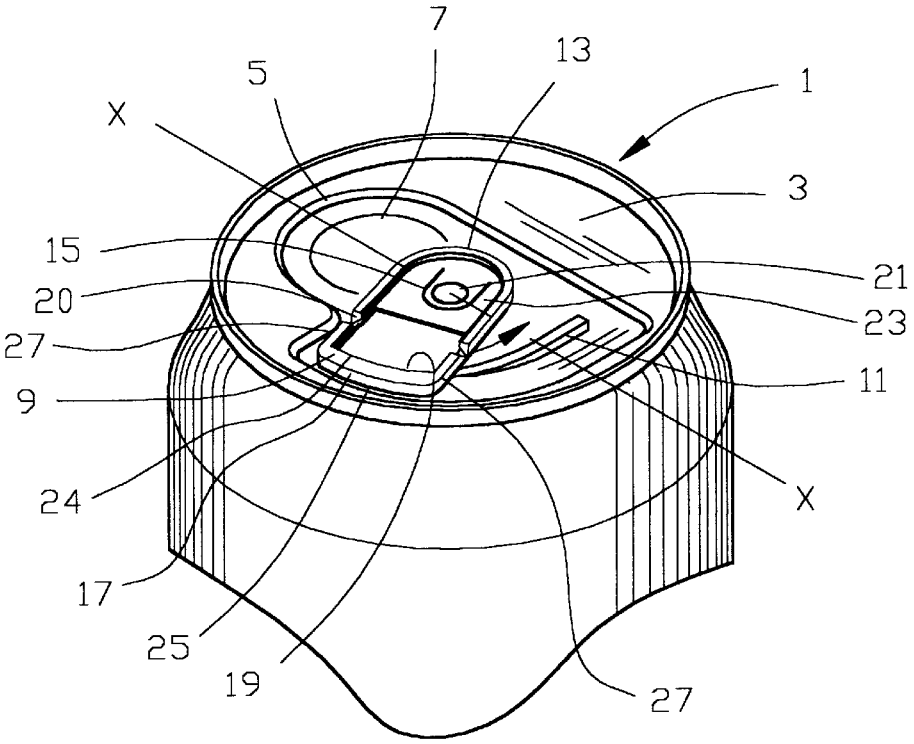
FIG. 1 is a top perspective view of a container with a first embodiment of the invention showing the rotatable controlled flex operating lever primarily positioned at the container top panel.

FIG. 1 is a top perspective view of an easy opening beverage container 1 embodying a first embodiment on the invention. The easy opening beverage container 1 comprises a top panel 3 secured to the container 1. The top panel 3 has a scored area 5 for defining a closure portion 7. A longitudinal axis X—X extends through the closure portion 7.

The closure portion 7 is frangibly secured to the top panel 3 for enabling the closure portion 7 to be partially severed from the top panel 3 and pushed into the container 1. The closure portion 7 is partially severed from the top panel 3 and pushed into the container 1 by an effort induced by an operating lever 9. The top panel 3 has an elevated portion in the form of an inclined plane 11 defined in the top panel 3 which is elevated relative to the top panel 3. FIG. 1 illustrates the operating lever 9 in a primarily position on the top panel 3 of the container 1.

Figure 2:
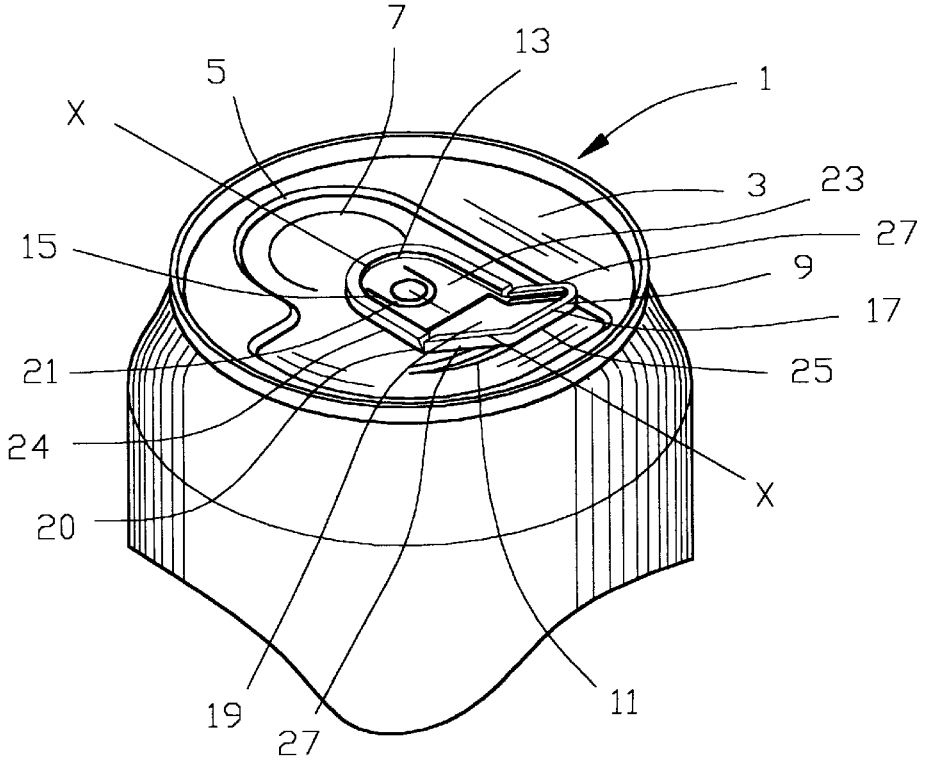
FIG. 2 is a top perspective view of a container of FIG. 1 showing the rotated controlled flex operating lever at the maximum elevation point of the inclined plane and in a controlled flex attitude.

FIG. 2 is a top perspective view similar to FIG. 1 with the operating lever 9 shown in a rotated orientation to be positioned on a maximum elevation point of the inclined plane 11.

Figure 3:
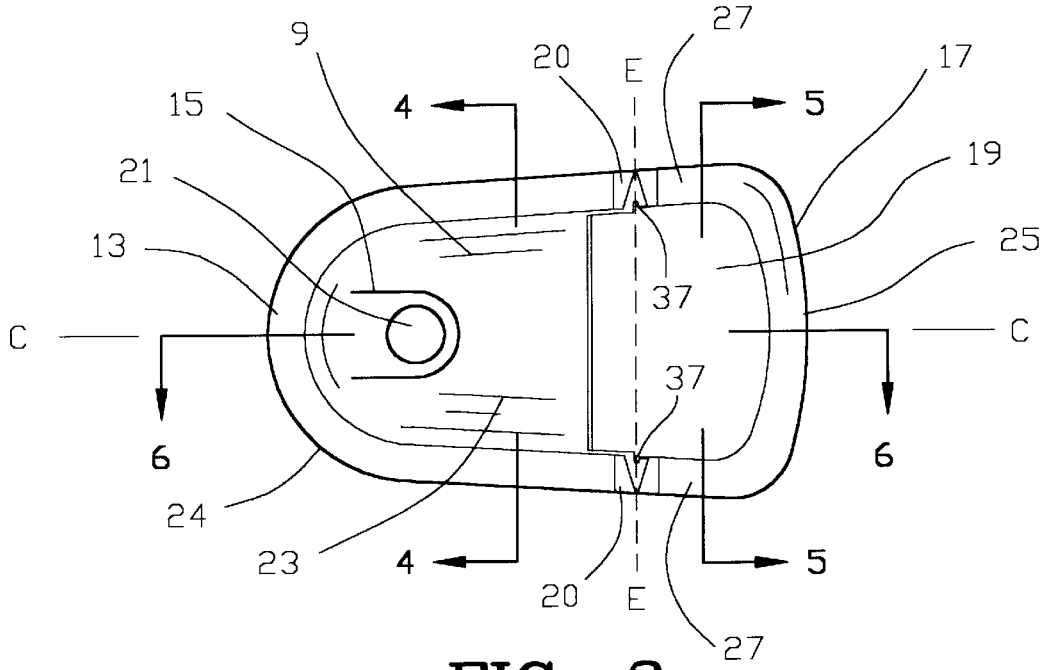
FIG. 3 is an enlarged top view of the operating lever of FIGS. 1 and 2.

FIG. 3 is an enlarged top view of the operating lever 9 of the invention shown in FIGS. 1 and 2. The operating lever 9 has a nose portion 13 including a bendable anchoring lug 15 and a lift portion 17. The bendable anchoring lug 15 functions as a hinge. The lift portion 17 includes a cut out area 19 to provide an opening for accommodating a finger tip. A longitudinal axis C—C is defined by the operating lever 9.

In this first embodiment of the invention, the operating lever 9 is the general shape of an oval. The width of the nose portion 13 is substantially the same as the width of the lift portion 17.

The operating lever 9 is rotatably secured to the top panel 3 by a rivet 21 extending through the anchoring lug 15. The rivet 21 extends generally at a right angle to a longitudinal axis of the closure portion 7. The nose portion 13 of the operating lever 9 is disposed proximate to the closure portion 7 and the lift portion 17 of the operating lever 9 is disposed adjacent to the inclined plane 11 portion. The operating lever 9 includes an essentially flat base 23 having edges constituting the perimeter of the base 23. An operator is able to rotate the lift portion 17 of the operating lever 9 onto the inclined plane 11 portion of the top panel 3. As the height of the inclined plane 11 increases, the elevation of the lift end 17 of the operating lever 9 is correspondingly increased with relation to the top panel 3. The increase in the elevation of the lift end 17 of the operating lever 9 to allow an operator to safely and efficiently engage a finger on the lift end 17 of the operating lever 9.

An important aspect of the present invention includes a means to compoundingly increase the height of the lift end portion 17 of the operating lever 9 far beyond that of the maximum height of the inclined plane 11. The means to compoundingly increase the height of the lift end portion 17 of the operating lever 9 includes a controlled flex portion 20 in the operating lever 9 interposed between the anchoring means 15 and a finger tip contact portion 25 of the operating lever 9.

The improvement of this invention comprises the novel controlled flex portion 20 of the operating lever 9 cooperating with an inclined plane 11 that easily raises the lift end 17 of the operating lever 9 to an attitude that allows an operator to safely and efficiently engage a finger on the lift end 17 of the operating lever 9 and proceed with the opening process.

Figure 4:
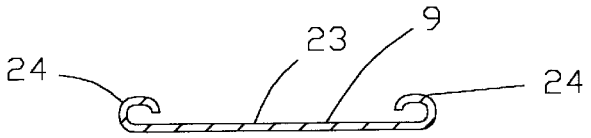
FIG. 4 is a cross-sectional view of FIG. 3 taken at along line 4—4.
Figure 5:
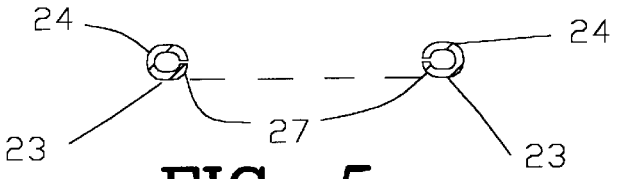
FIG. 5 is a cross-sectional view of FIG. 3 taken at Line 5—5.
Figure 6:
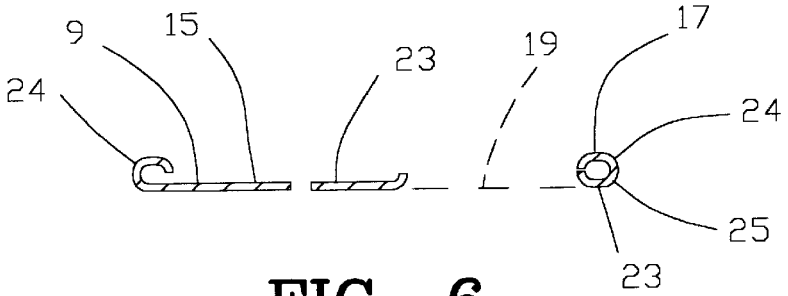
FIG. 6 is a cross-sectional view of FIG. 3 taken at Line 6—6.

As shown in FIGS. 4–6, the base 23 of the operating lever 9 is essentially flat having edges constituting the perimeter of the base 23. The edges of the base 23 include are generally rolled upward and inward in such a manner as to form a high strength generally overhanging generally semi-tubular configuration 24.

The cut out area 19 in the lift end 17 of the operating lever 9 is generally enclosed within the confines of the lift end 17 of the operating lever 9. The cut out area 19 provides an opening for accommodating a finger tip of the operator. The finger tip contact portion 25 is defined at the extreme end of the lift end 17 of the operating lever 9.

The finger contact portion 25 of the lift end 17 of the operating lever 9 includes generally longitudinal oriented enclosing portions 27. One end of each longitudinal oriented enclosing portions 27 is attached to the base 23 of the operating lever 9. The opposite end of the enclosing portions 27 is attached to the lift portion 17 thereby defining the finger contact portion 25. The enclosing portions 27 and the lift portion 17 form the opening 19 for finger tip of the operator.

The controlled flex portion 20 in the operating lever 9 is interposed between the anchoring means 15 and a finger tip contact portion 25 of the operating lever 9. The controlled flex portion 20 is generally located in each longitudinal oriented enclosing portions 27. The controlled flex portion 20 enables the lift end 17 of the operating lever lift end 17 to flex generally upwardly relative to the nose portion 13.

Figure 7:
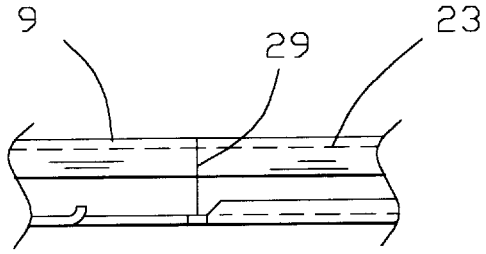
FIG. 7 is an enlarged view of one of two flex portions of FIG. 3 showing a parting line stage of development prior to formation of opposing flat surfaces.

FIG. 7 is an enlarged view of the development of the controlled flexible portion 20 showing the base 23 and the forming of a parting line 29 in the base 23. The controlled flex portion 20 is developed by first forming a parting line 29 prior to rolling the longitudinal oriented enclosing portions 27.

Figure 7A:
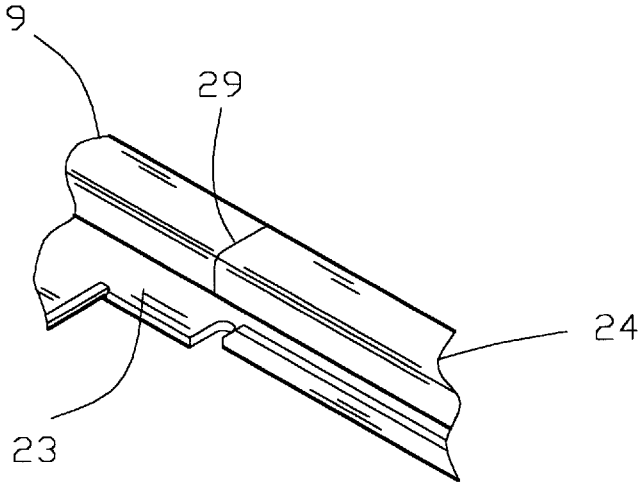
FIG. 7A is an isometric view of one of two flex portions of FIG. 3 showing a parting line stage of development by the rolling of a base prior to formation of opposing flat surfaces.

FIG. 7A is an isometric view of the development of the controlled flexible portion 20 showing the base 23 being rolled prior to formation of opposing flat surfaces. The controlled flex portion 20 is developed by secondly rolling the base 23 to form the semi-tubular configuration 24. The parting line 29 extends through the semi-tubular configuration 24 of the longitudinal oriented enclosing portions 27 down to but not including the base 23. The rolling is done upwardly and inwardly such that the base 23 is not mechanically worked during the rolling process.

Figure 8:
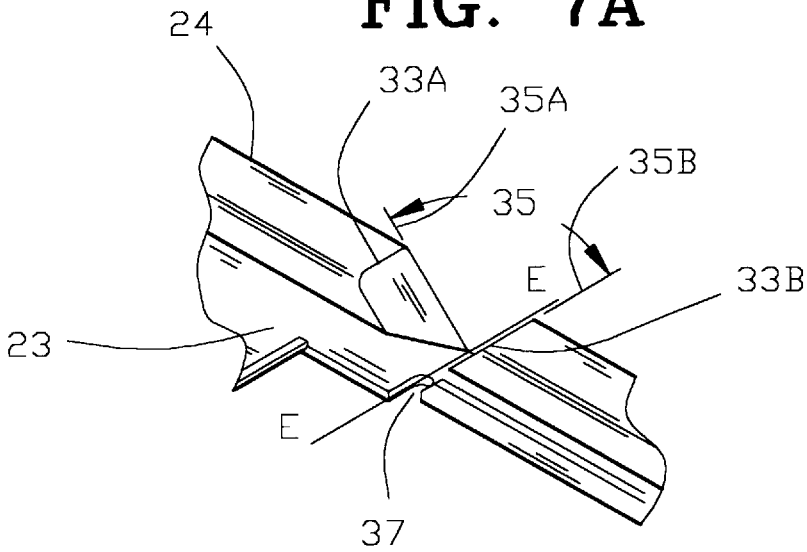
FIG. 8 is an enlarged isometric view of one of two flex portions of FIG. 3 showing the formed opposing flat surfaces.

FIG. 8 is an enlarged isometric view of the development of the controlled flexible portion 20 showing the forming of opposing flat surfaces 33A and 33B. The controlled flex portion 20 is developed by thirdly forming opposing flat surfaces 33A and 33B from the partings sides 29A and 29B of the generally semi-tubular configuration 24. The opposing flat surfaces 33A and 33B are disposed on either side of the controlled flex portion 20.

FIG. 8 is an enlarged isometric view of the controlled flex portion 20 in the operating lever 9. The flexing takes place in the base 23 of the operating lever 9 at a location that is generally the apex of the angle 35 formed by the two opposing sets of plates 35A and 35B. The flexing of the base 23 of the operating lever 9 is along line E—E that is generally perpendicular to the longitudinal axis C—C of the operating lever 9.

The flexing of the controlled flex portion 20 is facilitated by a control notch 37 placed in the base 23 of the operating lever 9. The control notch 37 is placed in line with line E—E in such a manner as to determine the width of the base 23 at the controlled flex portion 20. The width of the base 23 at the controlled flex portion 20 in part determines the resistance to flexing of the operating lever 9.

The industry standard with relation to the 180 degree bending of the operating lever anchoring lug 15 hinge of the prior art is a minimum of 3 complete bends. The controlled flex portion 20 of the present invention, flexes only through the angle 31 or about 45 degrees. Accordingly, the present invention provides an inherent safety factor considerably higher than the prior art.

Figure 9:
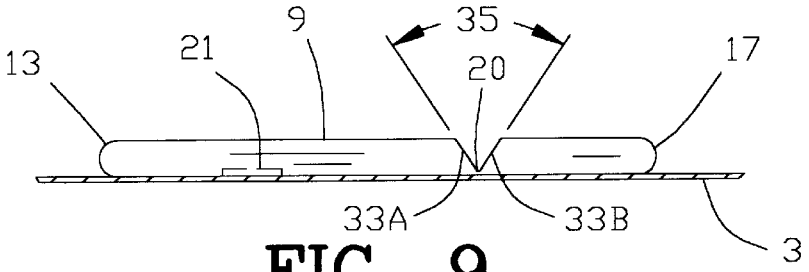
FIG. 9 is a side view of the controlled flex operating lever primarily positioned on the surface of the container top panel.
Figure 9A:
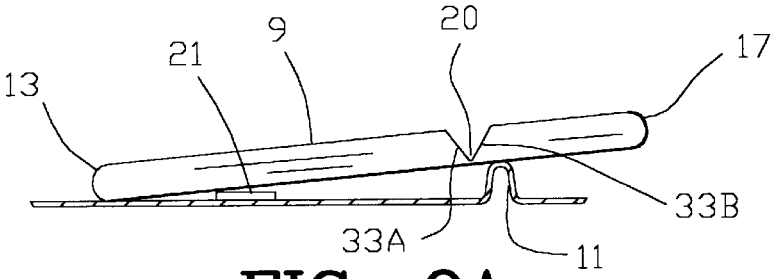
FIG. 9A is a side view of the controlled flex operating lever positioned at the maximum elevation point of the inclined plane.
Figure 9B:
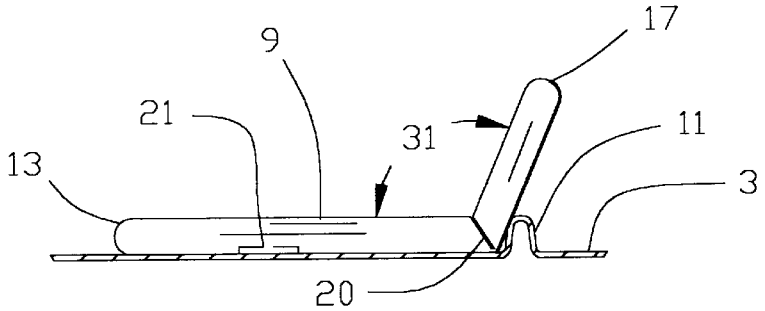
FIG. 9B is a side view of the controlled flex operating lever in the flexed attitude.

FIG. 9, 9A and 9B illustrate the function of the improved operating lever 9. The controlled flex portion 20 cooperates with the inclined plane 11 to raise the lift portion 17 as will be described in greater detail hereinafter.

FIG. 9 illustrates the improved operating lever 9 in an initial position. The operating lever 9 is shown in the initially position in FIG. 1

FIG. 9A illustrates the improved operating lever 9 as an operator laterally rotates the operating lever 9 to a position towards that shown in FIG. 2. As the operating lever 9 moves up the inclined plane 11, the inclined plane 11 exerts an upward force on the lift portion 17 of the operating lever 9.

FIG. 9B illustrates the improved operating lever 9 as the operating lever 9 is laterally pivoted by an operator to the position shown in FIG. 2. The operating lever 9 is laterally pivoted to a point where the longitudinal axis C—C of the operating lever 9 is generally in line with the longitudinal axis X—X of the closure portion 7. The upward force exerted by the inclined plane 11 on the lift portion 17 of the operating lever 9 causes the lift portion 17 to bend relative to the nose portion 13 about the controlled flex portion 20. The action of the operating lever 9 and the inclined plane 11 raises the lift end 17 of the operating lever 9 to a position that easily allows an operator to place a finger on the operating lever finger contact portion 25 and complete the opening process.

The maximum upward angle 31 of lift end 17 relative to the nose portion 13 is determined by the opposing flat surfaces 33A and 33B of the generally semi-tubular configuration 24. The plane of the flat surfaces 33A and 33B is generally formed at right angles to the longitudinal axis C—C of the operating lever 9. The angle 35 included between the formed flat surfaces 33A and 33B determines the maximum angle 31 of lift end 17 relative to the nose portion 13. The flat surfaces 33A and 33B limit the flexing of the controlled flex portion 20 upon the opposing flat surfaces 33A and 33B coming into mutual contact as shown in FIG. 9B. When the opposing flat surfaces 33A and 33B comes into mutual contact as shown in FIG. 9B, the nose portion 13 and the lift portion 17 function as a single unit when the operator raises the lift portion 17 to proceed with the container 1 opening process.

Figure 10:
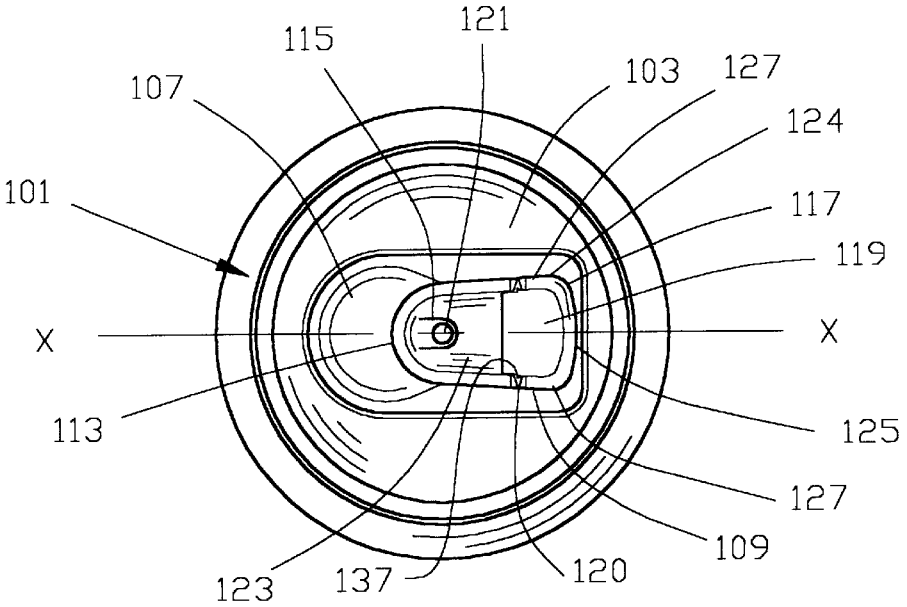
FIG. 10 is a top view of a second embodiment of the invention showing the primarily positioned controlled flex operating lever in a non-rotatably position on the container.

FIG. 10 is an enlarged top view of a second embodiment of the invention. In this embodiment of the invention, the easy opening beverage container 101 comprises a top panel 103 secured to the container 101. The top panel 103 has a scored area 105 for defining a closure portion 107. A longitudinal axis X—X extends through the closure portion 107.

The closure portion 107 is frangibly secured to the top panel 103 for enabling the closure portion 107 to be partially severed from the top panel 103 and pushed into the container 101.

The operating lever 109 has a nose portion 113 including a bendable anchoring lug 115 and a lift portion 117. The bendable anchoring lug 115 functions as a hinge. The lift portion 117 includes a cut out area 119 to provide an opening for accommodating a finger tip.

In this second embodiment of the invention, the operating lever 109 is the general shape of an oval. The width of the nose portion 113 is substantially the same as the width of the lift portion 117.

In this embodiment of the invention, the operating lever 109 is non-rotatably secured at the anchoring lug 115 to the top panel 103 by means of a rivet 121 located generally at the surface of the center of the top panel 103. The longitudinal axis C—C of the secured operating lever 109 is generally in line with the longitudinal axis X—X of the closure portion 107.

The initial lifting of the lift end 117 of the operating lever 109 is easily accomplished thorough the flexing of the controlled flex portion 120 of the operating lever 109. The lift end 117 of the operating lever 109 is lifted through the flexing of the controlled flex portion 120 until the lift end 117 of the operating lever 109 is raised to a predetermined angle as set forth previously. The elevated lift end 17 of the operating lever 9 provides a safe and comfortable finger surface 125 that easily allows the operator to complete the opening of the container. When the operating lever 109 is raised to a predetermined angle, the nose portion 113 and the lift portion 117 function as a single unit when the operator raises the lift portion 117 to proceed with the opening of the container 101.

Figure 11:
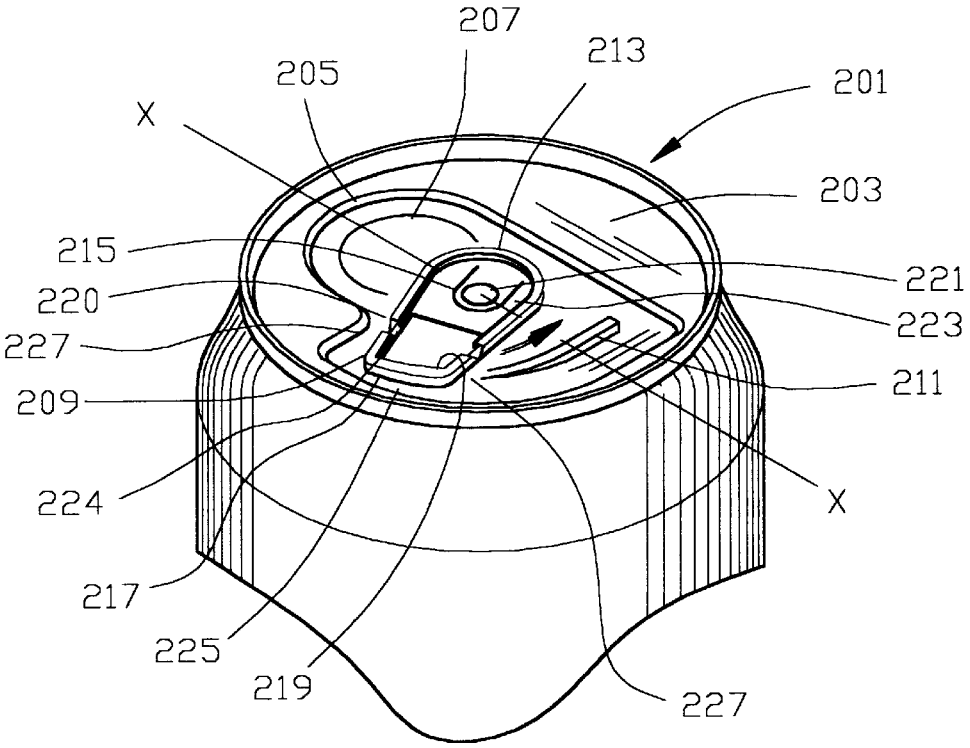
FIG. 11 is a top perspective view of a container with a third embodiment of the invention showing the rotatable controlled flex operating lever primarily positioned at the container top panel.

FIG. 11 is a top perspective view of a beverage container 201 embodying a third embodiment on the invention. The beverage container 201 comprises a top panel 203 secured to the container 201 with the top panel 203 having a scored area 205 for defining a closure portion 207. A longitudinal axis X—X extends through the closure portion 207.

The closure portion 207 is frangibly secured to the top panel 203 for enabling the closure portion 207 to be partially severed from the top panel 203 and pushed into the container 201 by an operating lever 209. The top panel 203 has an elevated portion in the form of an inclined plane 211. FIG. 11 illustrates the operating lever 209 is a primarily position on the top panel 203 of the container 201.

Figure 12:
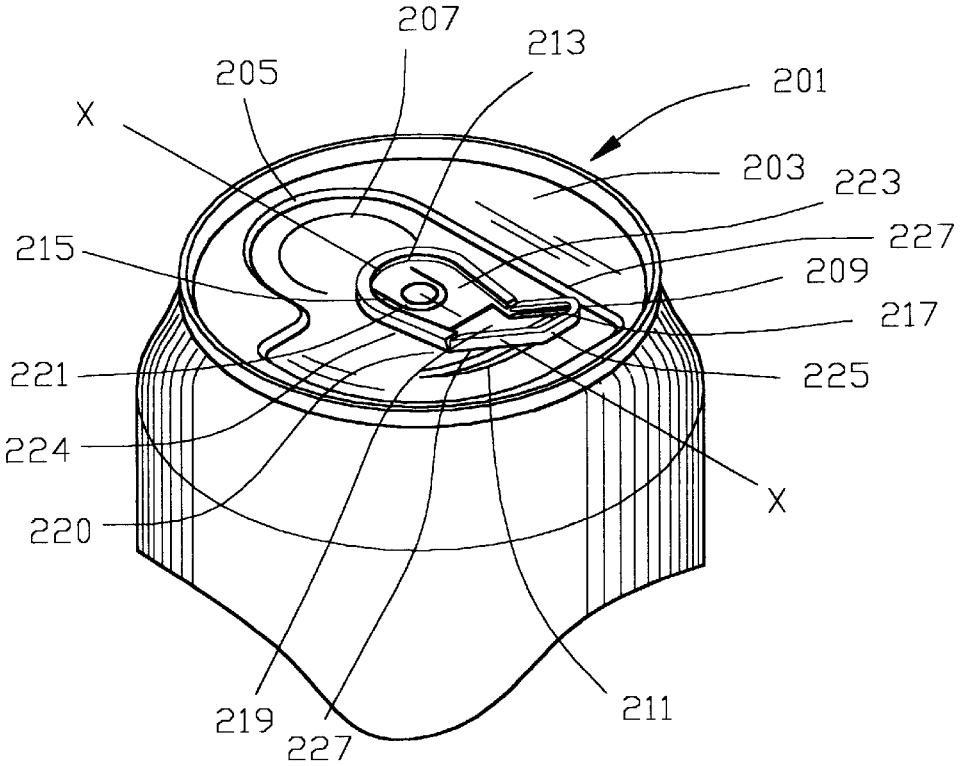
FIG. 12 is a top perspective view of a container of FIG. 11 showing the rotated controlled flex operating lever at the maximum elevation point of the inclined plane and in a controlled flex attitude.

FIG. 12 is a top perspective view similar to FIG. 11 with the operating lever 209 shown in a rotated orientation to be positioned on a maximum elevation point of the inclined plane 211.

Figure 13:
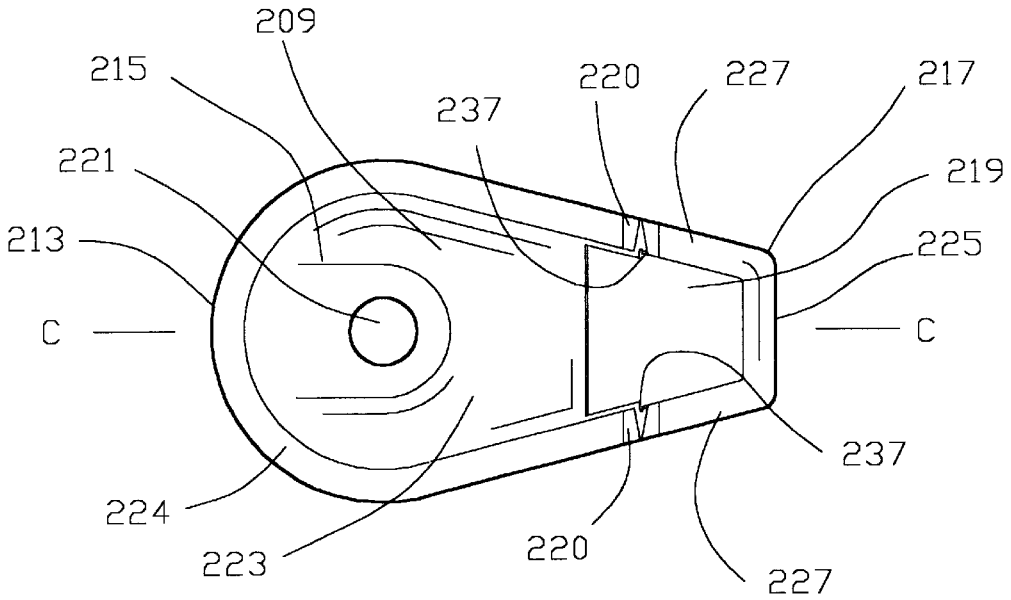
FIG. 13 is an enlarged top view of the operating lever of FIGS. 11 and 12.

FIG. 13 is an enlarged top view of the operating lever 209 of the invention shown in FIGS. 11 and 12. The operating lever 209 comprises a nose portion 213 including a bendable anchoring lug 215 and a lift portion 217. The lift portion 17 includes a cut out area 219. A longitudinal axis C—C is defined by the operating lever 209.

In this third embodiment of the invention, the operating lever 209 is the general shape of a tear drop. The width of the nose portion 213 is greater than the width of the lift portion 217. As will be described in greater detail hereinafter, the narrower width of the lift portion 217 saves a considerable amount of material.

The operating lever 209 is rotatably secured to the top panel 203 by a rivet 221 extending through the anchoring lug 215. The nose portion 213 of the operating lever 209 is disposed proximate to the closure portion 207 and the lift portion 217 of the operating lever 209 is disposed adjacent to the inclined plane 211 portion. The operating lever 209 includes an essentially flat base 223 having edges constituting the perimeter of the base 223.

The operating lever 209 includes a controlled flex portion 220 in the operating lever 209 interposed between the anchoring means 215 and a finger tip contact portion 225 of the operating lever 209.

The initial lifting of the lift end 217 of the operating lever 209 is easily accomplished thorough the flexing of the controlled flex portion 220 of the operating lever 209. The lift end 217 of the operating lever 209 is lifted thorough the flexing of the controlled flex portion 220 until the lift end 217 of the operating lever 209 is raised to a predetermined angle as set forth previously. The raised lift end 217 provides a safe and comfortable finger surface 225 that easily allows the operator to complete the opening of the container 201. When the operating lever 209 is raised to a predetermined angle, the nose portion 213 and the lift portion 217 function as a single unit when the operator raises the lift portion 217 to proceed with the opening of the container 201.

Figure 14:
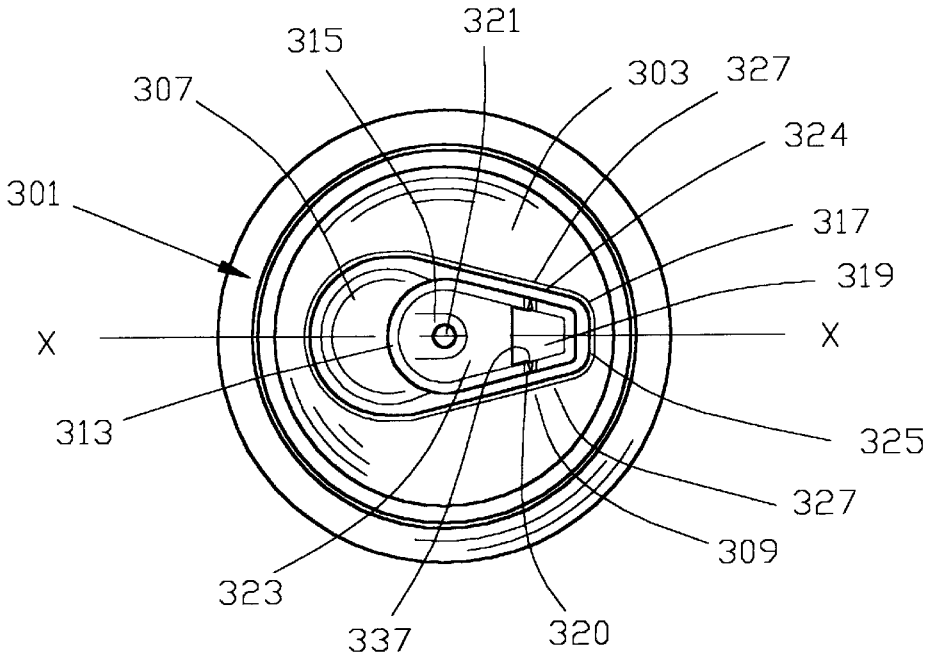
FIG. 14 is a top view of a fourth embodiment of the invention showing the primarily positioned controlled flex operating lever in a non-rotatably position on the container.

FIG. 14 is an enlarged top view of a fourth embodiment of the invention. In this embodiment of the invention, the easy opening beverage container 301 comprises a top panel 203 secured to the container 301. The top panel 303 has a scored area 305 for defining a closure portion 307. A longitudinal axis X—X extends through the closure portion 307. The closure portion 307 is frangible secured to the top panel 303 for enabling the closure portion 307 to be partially severed from the top panel 303 and pushed into the container 301. The operating lever 309 has a nose portion 313 including a bendable anchoring lug 315 and a lift portion 317. The bendable anchoring lug 315 functions as a hinge. The lift portion 317 includes a cut out area 319 to provide an opening for accommodating a finger tip.

In this fourth embodiment of the invention, the operating lever 309 is the general shape of a tear drop. The width of the nose portion 313 is greater than the width of the lift portion 317. As will be described in greater detail hereinafter, the narrower width of the lift portion 317 saves a considerable amount of material.

In this embodiment of the invention, the operating lever 309 is non-rotatably secured at the anchoring lug 315 to the top panel 303 by means of a rivet 321 located generally at the surface of the center of the top panel 303. The longitudinal axis C—C of the secured operating lever 309 is generally in line with the longitudinal axis X—X of the closure portion 307.

The initial lifting of the lift end 317 of the operating lever 309 is easily accomplished thorough the flexing of the controlled flex portion 320 of the operating lever 309. The lift end 317 of the operating lever 309 is lifted thorough the flexing of the controlled flex portion 320 until the lift end 317 of the operating lever 309 is raised to a predetermined angle as set forth previously.

The raised lift end 317 provides a safe and comfortable finger surface 325 that easily allows the operator to complete the opening of the container. When the operating lever 309 is raised to a predetermined angle, the nose portion 313 and the lift portion 317 function as a single unit when the operator raises the lift portion 317 to proceed with the opening of the container 301.

Figure 15:
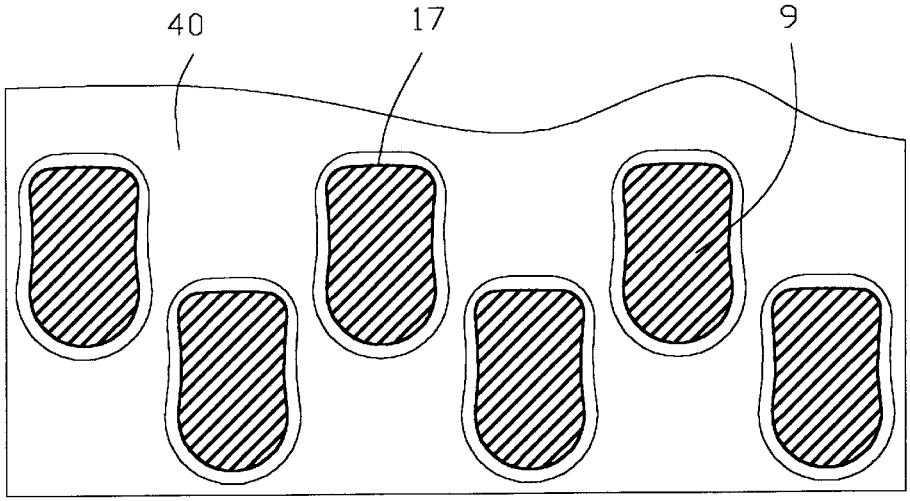
FIG. 15 is a plan view of a sheet of material illustrating a layout of a plurality of the operating levers of FIGS. 1–3 and 10.

FIG. 15 is a plan view of a sheet of material 40 illustrating a layout of an array of the operating levers 9 of FIGS. 1–3 and 10. Each of the operating lever 9 is the general shape of an oval. The width of the nose portion 13 is substantially the same as the width of the lift portion 17.

The array of the operating levers 9 is arranged to provide the maximum of operating levers 9 for the minimum of the sheet material 40. In this example, the array of the operating levers 9 comprises staggered rows of four operating levers 9 in each row.

Figure 16:
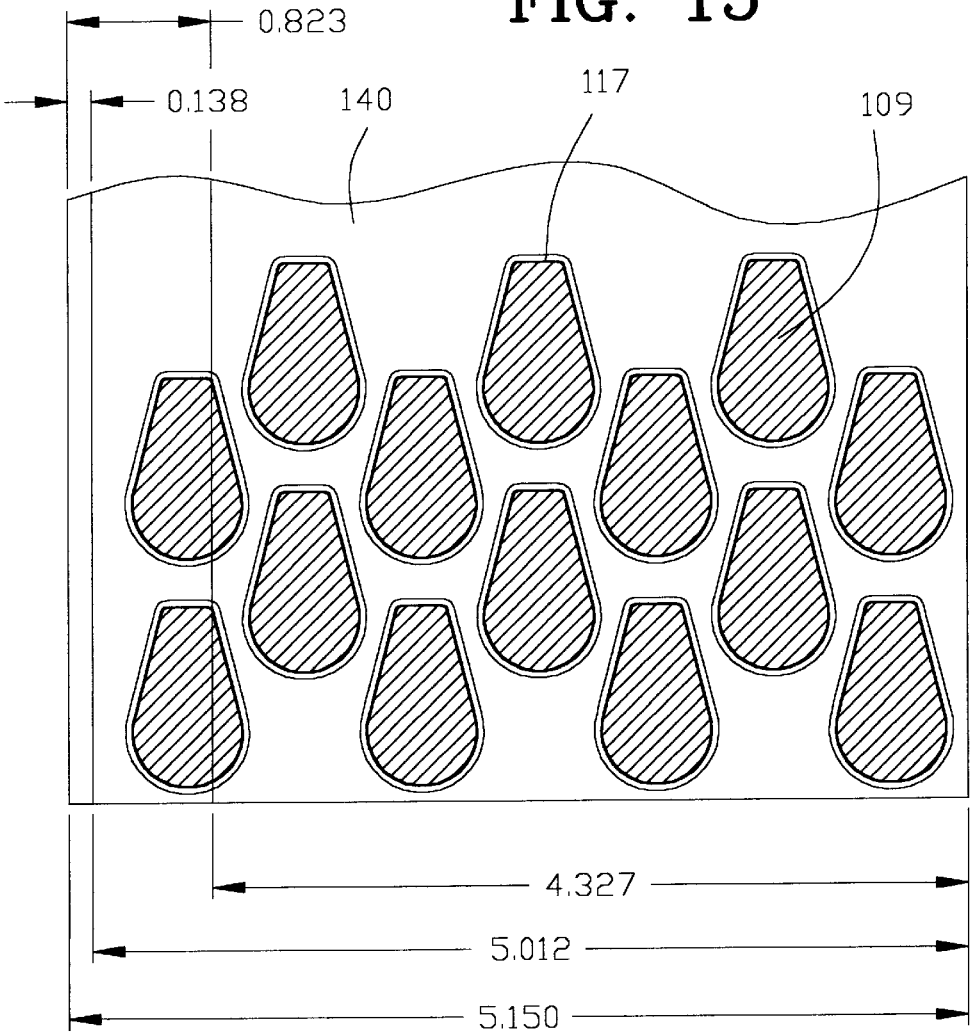
FIG. 16 is a plan view of a sheet of material illustrating a layout of a plurality of the operating levers of FIGS. 11–14.

FIG. 16 is a plan view of a sheet of material 140 illustrating a layout of an array of the operating levers 117 of FIGS. 11–14. Each of the operating lever 109 is the general shape of a tear drop. The width of the nose portion 113 is substantially more than the width of the lift portion 117.

The array of the operating levers 109 is arranged to provide the maximum of operating levers 109 for the minimum of the sheet material 140. In this example, the array of the operating levers 109 comprises staggered rows of four operating levers 109 in each row. However, since each of the operating lever 109 is the general shape of a tear drop, the array may be compressed while still maintaining the same spacing between adjacent operating levers 109.

The array of the operating levers 109 of FIG. 16 is compressed both in width and in length in relation to the width and the length of the array of the operating levers 9 shown in FIG. 15. Accordingly, the use of a tear drop shape for the operating lever 109 results in a saving in both material and in space. The dimensions associated with FIG. 16 indicate that a sixteen percent reduction in the sheet material may be achieved through the use of the tear drop shape the operating lever 109 of FIG. 16 relative to the oval shape operating lever 9 of FIG. 15.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An opener for a container, comprising:

a top panel having a scored area for defining a closure portion which is frangibly secured to said top panel for enabling said closure portion to be severed from said panel;

an operating lever having a nose portion and a lift portion with a controlled flex portion being disposed therebetween;

said lift portion having an opening for receiving a finger of an operator;

means for securing said operating lever to said top panel with said nose portion of said operating lever being disposed proximate said closure portion and with said lift portion of said operating lever being disposed remote therefrom;

said controlled flex portion enabling said lift portion to bend upwardly at said controlled flex portion relative to said nose portion upon raising said lift portion by an operator to expose said opening in said lift portion; and said upwardly bend lift portion facilitating the insert of a finger of the operator into said opening for enabling the operator to raise said lift portion of said operating lever to sever said closure portion from said top panel to open the container.

2. An opener for a container as set forth in claim 1, wherein said means for securing said operating lever to said top panel includes an anchoring rivet for securing said operating lever to said top panel.

3. An opener for a container as set forth in claim 1, wherein said means for securing said operating lever to said top panel includes an anchoring rivet interposed between said lift portion and said nose portion of said operating lever.

4. An opener for a container as set forth in claim 1, wherein said means for securing said operating lever to said top panel includes an anchoring rivet interposed between said lift portion and said nose portion of said operating lever; and said lift portion of said operating lever has a greater longitudinal length than a longitudinal length of said nose portion for providing a mechanical advantage for said operating lever.

5. An opener for a container as set forth in claim 1, wherein said nose portion defines a width of said operating lever and said lift portion defines a width of said operating lever; and said width of said nose portion being substantially similar to said width of said lift portion.

6. An opener for a container as set forth in claim 1, wherein said nose portion defines a width of said operating lever and said lift portion defines a width of said operating lever; and said width of said nose portion being substantially less than said width of said lift portion.

7. An opener for a container as set forth in claim 1, wherein said operating lever is in the general form of an oval.

8. An opener for a container as set forth in claim 1, wherein said operating lever is in the general form of a tear drop.

9. An opener for a container as set forth in claim 1, including a control notch defined in said controlled flex portion for controlling the flexibility of said controlled flex portion.

10. An opener for a container as set forth in claim 1, including a control notch defined in said controlled flex portion for controlling the flexibility of said controlled flex portion; and said control notch varying the width of said controlled flex portion for controlling the flexibility of said controlled flex portion.

11. An opener for a container, comprising:

a top panel having a scored area for defining a closure portion which is frangibly secured to said top panel for enabling said closure portion to be severed from said panel;

said top panel having an arcuate incline plane extending from a surface of said top panel;

an operating lever having a nose portion and a lift portion with a controlled flex portion being disposed therebetween;

said lift portion having an opening for receiving a finger of an operator;

means for rotatably securing said operating lever to said top panel with said nose portion of said operating lever being disposed proximate said closure portion and with said lift portion of said operating lever being disposed adjacent said arcuate incline plane;

said controlled flex portion enabling said lift portion to bend upwardly at said controlled flex portion relative to said nose portion upon rotation of said operating lever along said incline plane by an operator to expose said opening in said lift portion; and said upwardly bend lift portion facilitating the insert of a finger of the operator into said opening for enabling the operator to raise said lift portion of said operating lever to sever said closure portion from said top panel to open the container.

12. An opener for a container as set forth in claim 11, wherein said means for rotatably securing said operating lever to said top panel includes an anchoring rivet for rotatably securing said operating lever to said top panel.

13. An opener for a container as set forth in claim 11, wherein said means for rotatably securing said operating lever to said top panel includes an anchoring rivet interposed between said lift portion and said nose portion of said operating lever.

14. An opener for a container as set forth in claim 11, wherein said means for rotatably securing said operating lever to said top panel includes an anchoring rivet interposed between said lift portion and said nose portion of said operating lever; and said lift portion of said operating lever has a greater longitudinal length than a longitudinal length of said nose portion for providing a mechanical advantage for said operating lever.

15. An opener for a container as set forth in claim 11, wherein said means for rotatably securing said operating lever to said top panel includes an anchoring rivet interposed between said lift portion and said nose portion of said operating lever;

said lift portion of said operating lever having a greater longitudinal length than a longitudinal length of said nose portion for providing a mechanical advantage for said operating lever;

said elevated portion defined in said top panel including an inclined plane extending from a surface of said top panel; and said lift portion of said operating lever rides up said inclined plane upon rotation of said operating lever relative to said top panel to couple a mechanical advantage of said inclined plane to said mechanical advantage of said operating lever.

16. An opener for a container as set forth in claim 11, wherein said top panel is substantially circular;

said means for rotatably securing said operating lever to said top panel includes an anchoring rivet being located generally central of said substantially circular top panel; and said elevated portion being arcuately defined in said top panel about said anchoring rivet.

17. An opener for a container as set forth in claim 11, wherein said nose portion defines a width of said operating lever and said lift portion defines a width of said operating lever; and said width of said nose portion being substantially similar to said width of said lift portion.

18. An opener for a container as set forth in claim 11, wherein said nose portion defines a width of said operating lever and said lift portion defines a width of said operating lever; and said width of said nose portion being substantially less than said width of said lift portion.

19. An opener for a container as set forth in claim 11, wherein said operating lever is in the general form of an oval.

20. An opener for a container as set forth in claim 11, wherein said operating lever is in the general form of a tear drop.

* * * * *